US006096200A

United States Patent [19]

Bennett

[11] Patent Number: 6,096,200

[45] Date of Patent: Aug. 1, 2000

[54] FILTERING APPARATUS

[75] Inventor: Peter Joseph Bennett, Katoomba, Australia

[73] Assignee: Baramy Engineering Pty. Ltd., New South Wales, Australia

[21] Appl. No.: 09/200,579

[22] Filed: Nov. 27, 1998

[30] Foreign Application Priority Data

Nov. 27, 1997 [AU] Australia ..... PP0607

[51] Int. Cl.[7] ..... E03F 5/14

[52] U.S. Cl. ..... 210/155; 210/163; 210/170; 210/300

[58] Field of Search ..... 210/154, 155, 210/162, 163, 170, 300, 301, 348, 248, 299; 404/2, 4; 405/36, 39

[56] References Cited

U.S. PATENT DOCUMENTS

| | | | |
|---|---|---|---|
| 4,297,219 | 10/1981 | Kirk et al. | 210/155 |
| 4,476,021 | 10/1984 | Souza | 210/307 |
| 5,405,539 | 4/1995 | Schneider | 210/747 |
| 5,531,888 | 7/1996 | Geiger et al. | 210/170 |
| 5,674,386 | 10/1997 | Filion | 210/154 |

FOREIGN PATENT DOCUMENTS

| | | |
|---|---|---|
| 0760409 | 3/1997 | European Pat. Off. . |
| 2743580 | 3/1979 | Germany . |

*Primary Examiner*—David A. Simmons
*Assistant Examiner*—Frank M. Lawrence
*Attorney, Agent, or Firm*—Ladas & Parry

[57] ABSTRACT

A filter apparatus (10) having an upstream first filter grate (17) to which stormwater is delivered so that litter is filtered therefrom. Litter is delivered to a first litter collection surface (20). Extending upwardly from the surface (20) is a filter wall (22) having a filter portion (31) through which the stormwater again passes to filter litter therefrom. A second filter grate (24) extends from an upper portion of the wall (22), the second grate (24) leading to a second litter collection surface (26).

9 Claims, 3 Drawing Sheets

FILTERING APPARATUS

TECHNICAL FIELD

The present invention relates to pollution control and, in particular, to a filtering apparatus or pollutant trap adapted to extract litter from storm waste.

BACKGROUND OF THE INVENTION

Described in Australian Patent Application 64365/96 (U.S. Pat. No. 5,779,888) is an apparatus to filter litter from waterways, particularly stormwater systems.

The above discussed filter apparatus is most suited to applications in which there is a substantial head of water.

Many stormwater systems may not have at low flow rates, the preferable head of water required by the apparatus of the above Australian application.

Other filter apparatuses are described in Patent Specification Nos. GB2267, WO 94/17896, U.S. Pat. No. 4,801,377 and DE 2743580. Essentially, the filter apparatus described in these specifications do not address problems associated with low flow rates, and more particularly flow rates having a low head.

Further filter apparatuses are described in U.S. Pat. Nos. 4,081,374 and 5,141,650. The filter apparatus of these two specifications does not relate to the field of removing litter from stormwater systems. They do not address the problems associated with flow rates having a low head in stormwater systems. U.S. Pat. Nos. 5,232,587, 3,282,430, 1,825,169, 2,106,851, 3,123,455 and 5,531,888. Again the filter apparatus described in these specifications does not address the problems associated with stormwater systems having a low head.

OBJECT OF THE INVENTION

It is the object of the present invention to overcome or substantially ameliorate the above disadvantage.

SUMMARY OF THE INVENTION

There is disclosed herein a filter apparatus having an upstream end from which water, to be filtered, flows in a predetermined direction, said apparatus having:

- a first filter grate extending downwardly from said upstream end and having a plurality of filter bars extending generally parallel to said direction to remove solid litter from said water;
- a first litter collection surface extending from a downstream end of said first filter grate upon which litter removed from the water via said first filter grate is accumulated;
- a filter wall extending upwardly from said surface at a position spaced from said first grate, said filter wall having a filter portion through which water passes but removes litter therefrom;
- a second filter grate extending downwardly from an upper portion of said filter wall, said second filter grate having a plurality of generally parallel bars parallel to the direction of flow of water over the second filter grate; and
- a second litter collection surface, said second surface extending from a lower portion of said second filter grate and being adapted to retain litter filtered from said water by said second filter grate.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENT

Figure 1:
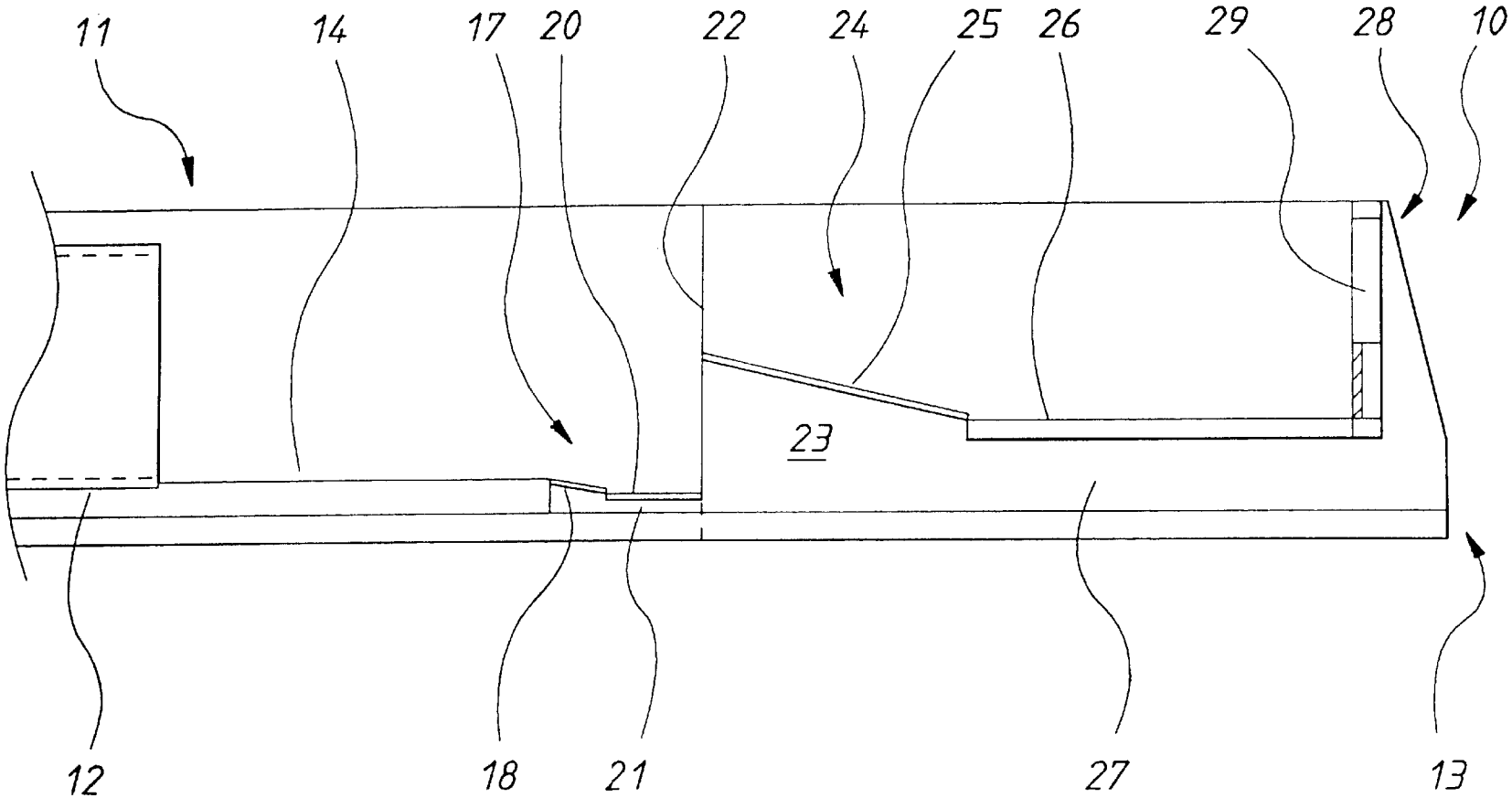
FIG. 1 is a schematic sectioned side elevation of a filter apparatus to remove litter from water.
Figure 2:
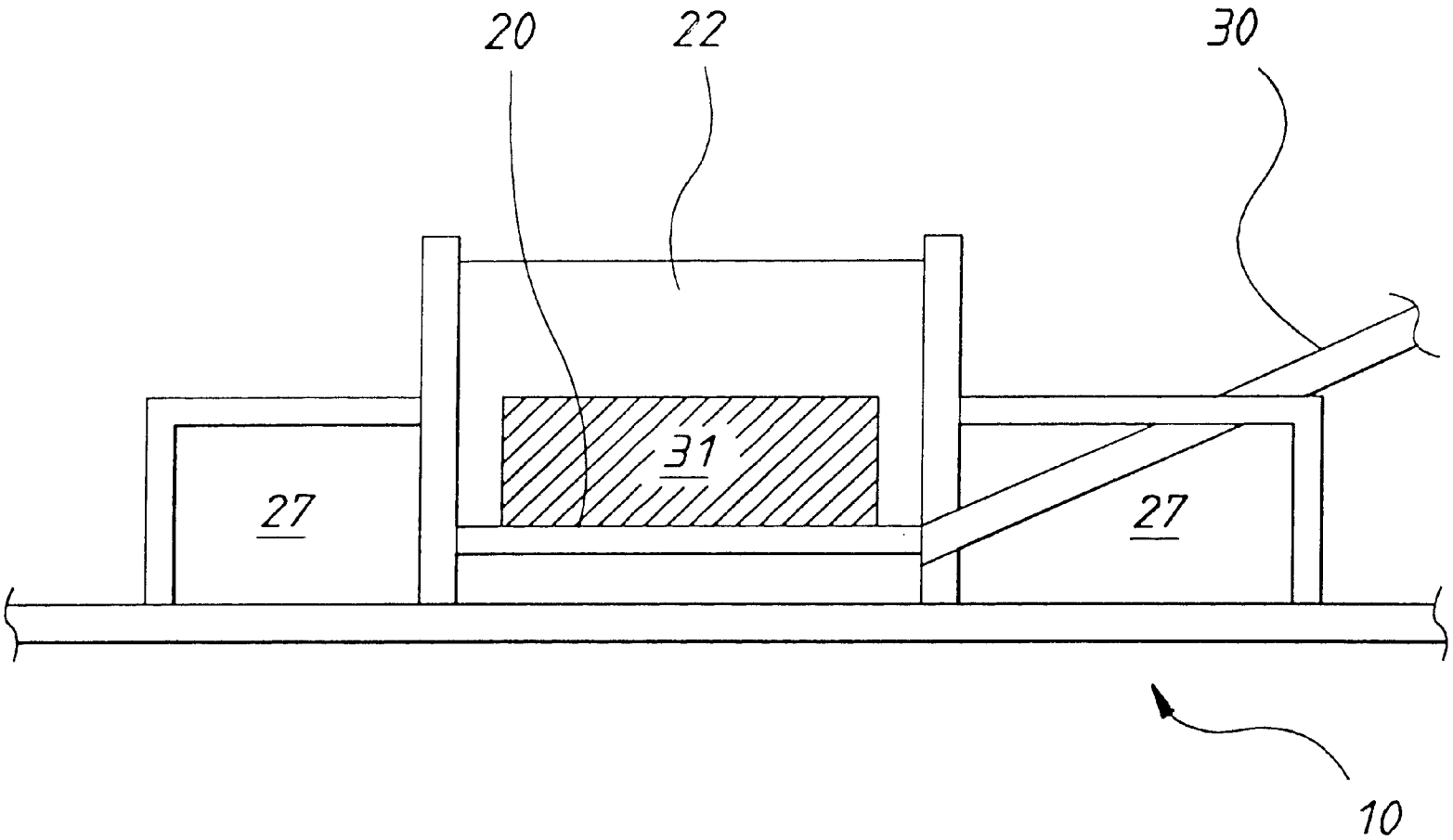
FIG. 2 is a schematic end elevation of the filter apparatus of FIG. 1.

In the accompanying drawings there is schematically depicted a filter apparatus 10. The filter apparatus 10 has an upstream end 11 which receives water (such as stormwater) from a pipe 12. The apparatus 10 has a downstream end 13.

The upstream end 11 has a generally horizontal (or slightly downwardly sloping from the pipe 12) surface 14 located between diverging side walls 15. The walls 15 diverge from the pipe 12 and extend to parallel walls 16.

Extending downwardly from the surface 14 is a first filter grate 17 which consists of a plurality of spaced generally parallel filter bars 18, which extend generally parallel to the direction 19 of water leaving the pipe 12 and passing over the surface 14.

Extending from the lower end of the first filter grate 17 is a litter collection surface 20 which may be provided by a sheet of compressed fiber/cement sheeting. Litter removed by the first filter grate 17 is urged to the surface 20 for collection by the flow of water over the first filter grate 17. Water also passes through the first filter grate 17 to enter a passage 21 which extends below the surface 20.

Extending upwardly from the surface 20 so as to be spaced from the first filter grate 17, is a filter wall 22. In this embodiment the filter wall 22 is generally vertical. The filter wall 22 includes bars or mesh (filter portion 31) which removes litter from 3 5 water that passes through the bars or mesh. This water passing through the bars or mesh enters a cavity 23 communicating with the passage 21 so as to deliver water thereto. The litter will generally fall to the surface 20.

Figure 3:
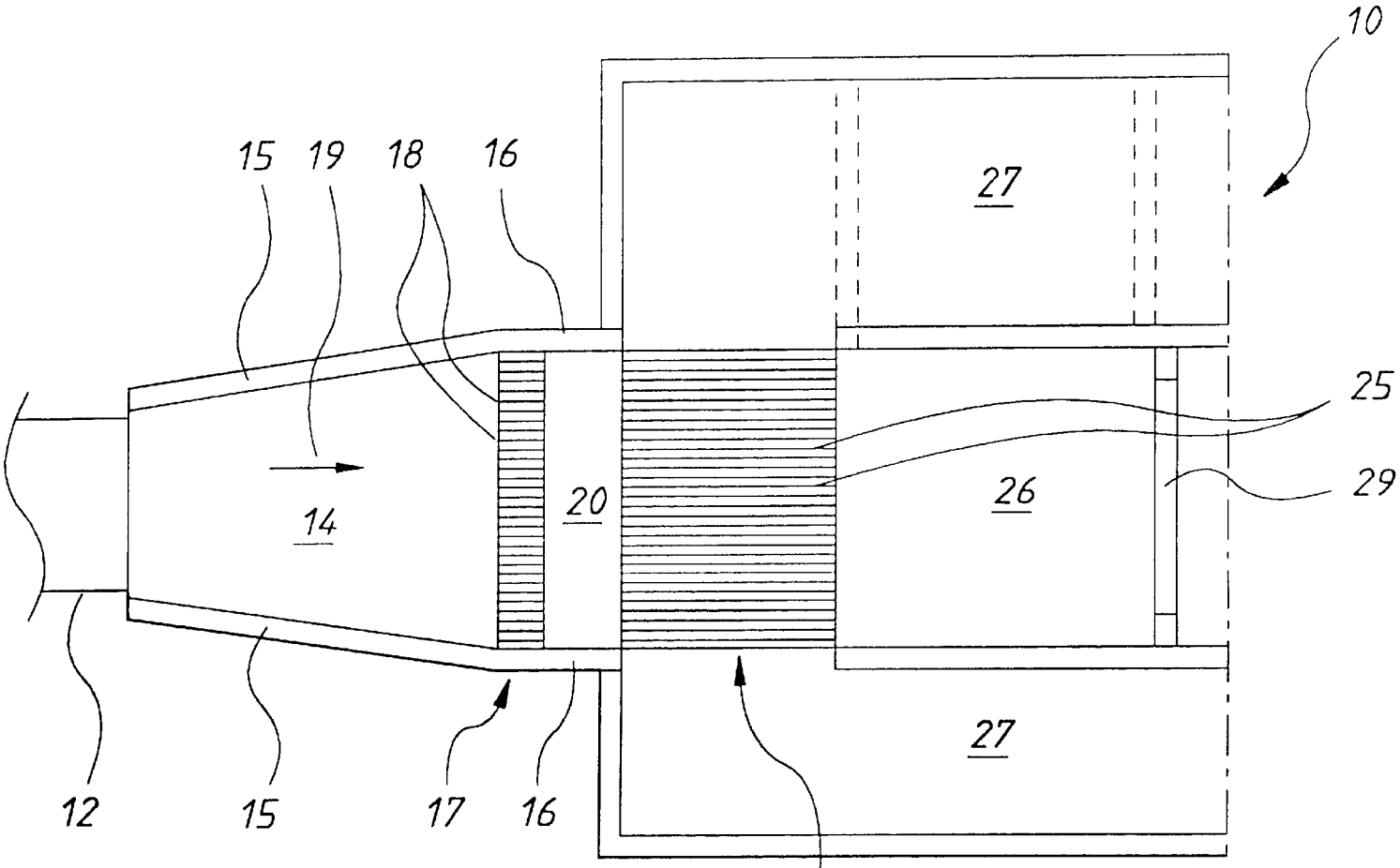
FIG. 3 is a schematic top plan view of the apparatus of FIG. 1.

Extending downwardly from an upper portion of the wall 22 is a second filter grate 24. The filter grate 24 comprises a plurality of generally parallel spaced bars 25, which are generally parallel to the direction 19. The bars 25 remove litter from water passing therethrough, which litter is delivered to a second collection surface 26. Water passing down the filter grate 24 urges the litter to t he collection surface 26. Water passing through the filter grate 24 enters the cavity 23 and flows to a further passage 27 wherefrom it is delivered to the stormwater system. The passage 27 is below the surface 26 as well as being spaced laterally as best seen in FIG. 3 so that water may exit from beneath the filter grate 24 laterally as well as beneath the surface 26.

The surface 26 is preferably sloped downwardly toward the filter grate 24 to aid in draining the surface 26.

Extending upwardly from the surface 26 is a rear wall (downstream and wall) 28 which may provide an overflow aperture 29, through which overflow water would pass to enter the passage 27.

Providing access to the surface 26 is a ramp 30. The ramp 30 enables manual cleaning of the surface 26. As an alternative construction the ramp 30 may provide vehicle access, again for removal of litter from the surface 26. In that regard it should be appreciated that a surface 20 is also exposed so that it may be manually cleaned.

As seen in FIG. 1, the surface 26 is higher than the surface 20, while said grate 25 is higher than the surface 20 and grate 18. The surface 14 is at approximately the same height as the surface 26.

What is claimed is:

1. A filter apparatus having an upstream end from which water, to be filtered, flows in a predetermined direction, said apparatus having:

a first filter grate extending downwardly from said upstream end and having a plurality of filter bars extending generally parallel to said direction to remove solid litter from said water;

a first litter collection surface extending from a downstream end of said first filter grate upon which litter removed from the water via said first filter grate is accumulated;

a filter wall extending upwardly from said surface at a position spaced from said first grate, said filter wall having a filter portion through which water passes but removes litter therefrom;

a second filter grate extending downwardly from an upper portion of said filter wall, said second filter grate having a plurality of generally parallel bars parallel to the direction of flow of water over the second filter grate; and a second litter collection surface, said second surface extending from a lower portion of said second filter grate and being adapted to retain litter filtered from said water by said second filter grate.

2. The filter apparatus of claim 1, further including a passage to receive water from said first filter grate, said filter portion and said second filter grate, said passage being adapted to communicate with a stormwater system.

3. The filter apparatus of claim 2, further including a ramp providing access to said second litter collection surface for the manual cleaning thereof.

4. The filter apparatus of claim 3, further including a downstream end wall adjacent said second litter collection surface but remote from said second filter grate, said downstream end wall having an overflow aperture to communicate with the stormwater system.

5. The filter apparatus of claim 4, wherein said overflow aperture communicates with said passage.

6. The filter apparatus of claim 5, wherein said second litter collection surface is higher than said first litter collection surface.

7. The filter apparatus of claim 6, wherein said second litter collection surface is above said first grate and said first litter collection surface.

8. The filter apparatus of claim 7, further including an upstream surface over which the water flows to be delivered to an upper portion of said first filter grate, said upstream surface being approximately at the same height as said second litter collection surface.

9. The filter apparatus of claim 8, wherein said passage has passage portions disposed laterally with respect to said second filter grate and said second liter collection surface.

* * * * *